US005211391A

United States Patent [19]

Kerr et al.

[11] Patent Number: 5,211,391

[45] Date of Patent: May 18, 1993

[54] AIR FLOW ASSISTED MATERIAL REMOVAL METHOD AND APPARATUS

[75] Inventors: Roger S. Kerr, Brockport; Scott L. Auer, Webster; Dennis W. Heizyk, Rochester; Donald F. Grube, Canandaigua, all of N.Y.

[73] Assignee: Eastman Kodak Company, Rochester, N.Y.

[21] Appl. No.: 945,778

[22] Filed: Sep. 16, 1992

Related U.S. Application Data

[63] Continuation of Ser. No. 762,834, Sep. 19, 1991, abandoned.

[51] Int. Cl.[5] ..... B65H 5/02

[52] U.S. Cl. ..... 271/276; 271/312; 346/138

[58] Field of Search ..... 271/194, 196, 276, 307, 271/309, 312, 313; 346/138; 354/340, 344; 355/73, 76, 312, 315

[56] References Cited

U.S. PATENT DOCUMENTS

| | | | |
|---|---|---|---|
| 3,837,640 | 9/1974 | Norton et al. | 271/313 |
| 3,955,813 | 5/1976 | Edwards | 271/309 |
| 4,157,178 | 6/1979 | Ollenaick | 271/276 |
| 4,237,466 | 12/1980 | Scranton | 271/276 X |
| 5,090,685 | 2/1992 | Danon et al. | 271/276 |

*Primary Examiner*—Robert P. Olszewski

*Assistant Examiner*—Boris Milef

*Attorney, Agent, or Firm*—Robert L. Randall

[57] ABSTRACT

A sheet removal apparatus for unloading a sheet from a hollow drum mounted for rotation about its axis and having a vacuum provided to the interior thereof and to first and second sets of vacuum openings through the surface of the drum. The sheet is arranged to overlie and close the first set of vacuum openings with the second set of openings extending substantially parallel with an edge of the sheet and comprising only a small portion of the total number of vacuum openings through the drum. An exit blade is disposed adjacent the drum and has an edge proximate the drum that extends substantially parallel to the edge of the sheet and forms an acute angle with the drum surface with the proximate edge of the blade closely adjacent the apex of the angle and parallel with the edge of the sheet. When the drum is rotated to a sheet removal position, the first set of vacuum openings lies beneath the acute angle when the edge of the sheet is disposed on the opposite side of the apex. The improvement comprises spacing the proximate edge of the exit blade sufficiently close to the surface of the drum that while the exit blade clears the sheet disposed on the drum, the vacuum drawn through the second set of vacuum openings creates an area of relatively high pressure air at the apex whereby air is forced past the apex with sufficient force to lift the edge of the sheet from the surface of the drum.

4 Claims, 2 Drawing Sheets

AIR FLOW ASSISTED MATERIAL REMOVAL METHOD AND APPARATUS

CROSS-REFERENCE TO RELATED APPLICATIONS

This application is a continuation of U.S. application Ser. No. 762,834 filed Sep. 19, 1991 entitled "Air Flow Assisted Material Removal Method and Apparatus" by Roger S. Kerr et al now abandoned.

RELATED APPLICATIONS

The present application is related to the following commonly assigned co-pending applications: U.S. Ser. No. 729,228, entitled LASER THERMAL PRINTER METHOD AND APPARATUS, filed Aug. 23, 1991, in the names of Raymond J. Harshbarger, William G. Fahey, Ronald R. Firth, Seung Ho Baek and Charles D. DeBoer; U.S. Ser. No. 749,399, entitled MULTI-CHAMBERED IMAGING DRUM, filed Aug. 23, 1991, in the name of Roger S. Kerr; and U.S. Ser. No. 749,230, entitled METHOD AND APPARATUS FOR LOADING AND UNLOADING SUPER-POSED SHEETS ON A VACUUM DRUM, filed Aug. 23, 1991, in the names of Roger S. Kerr and James K. Lucey.

BACKGROUND OF THE INVENTION

1. Field of the Invention

The present invention relates to a color proofing apparatus which utilizes an electronic signal input, and more particularly, to a method and apparatus for assisting the removal of a finished proof as carried by a receiver sheet from apparatus for automatically producing full-color proof images using lasers to provide thermal energy to a series of color dye-donors to selectively transfer each dye in registration to the receiver to form the proof image.

2. Description of the Prior Art

Color-proofing is the procedure used by the printing industry for creating representative images that replicate the appearance of printed images without the cost and time required to actually set up a high-speed, high-volume printing press to print an example of the images intended. In the past, these representative images, or proofs, have been generated from the same color-separations used to produce the individual color printing plates used in printing presses so that variations in the resulting images can be minimized. Various color-proofing systems have been devised to create the proofs and have included the use of smaller, slower presses as well as means other than presses, such as photographic, electrophotographic, and non-photographic processes.

The proofs generated are judged for composition, screening, resolution, color, editing, and other visual content. The closer the proof replicates the final image produced on the printing press, as well as the consistency from image to image, from press to press, and from shop to shop, the better the acceptance of the proofing system by the printing industry. Other considerations used in judging proofing systems include reproducibility, cost of the system as well as cost of the individual proofs, speed, and freedom from environmental problems. Further, since nearly all printing presses utilize the half-tone process for forming pictorial images, wherein the original image is screened, i.e. photographed through a screen to produce one or more printing plates containing an image formed of a plurality of fine dots that simulate the varying density of the original image, proofing processes that employ the half-tone process to form the proof image have been better accepted by the printing industry than have continuous tone systems.

With the advent of electronic systems for the generation of printing plates from electronic data stored in appropriate data storage devices in the form of electronically separated single color separations, the use of photographic color separations for generating proof images has become somewhat archaic, and a variety of processes have been developed and implemented to electronically form, store, and manipulate images both for generating the actual printing plates as well as for generating the proof images. While some of these electronic systems can handle and produce analog images, the most widely used systems employ digital processes because of the ease of manipulation of such digital images. In each of these electronic processes it is possible to display the resulting image on a CRT display, but it is generally necessary to produce a "hard copy" (i.e. an image actually formed on a sheet of paper or other material) before it can be fully assessed for approval of the final printing operation. Thus, each of these electronic systems requires the use of some form of output device or printer which can produce a hard copy of the image for actual evaluation. It is to the field of proofing output devices that the present invention is directed.

While purely photographic processes can provide accurate reproductions of image, they do not always replicate the reproduction resulting from printing presses. Further, most photographic processes do not produce half-tone images that can be directly compared to the printed images they are intended to emulate. Moreover, they are almost universally incapable of reproducing the images on the wide variety of paper or other material that can be run through a printing press. It is known that the appearance of the final printed image is affected by the characteristics of the paper or other material upon which it is printed. Thus, the ability to form the proof image on the material actually to be used in the press can be a determining factor in the market success of the proofing system.

Other continuous tone proofing systems, such as thermal processes and ink-jet systems have been developed, but they do not replicate the half-tone images so desired by the printing industry.

Electrophotographic proofing systems with half-tone capability have been introduced which employ either wet or dry processes. The electrophotographic systems that use dry processes suffer from the lack of high resolution necessary for better quality proofing, particularly when the images are of almost continuous tone quality. This results from the fact that dry electrophotographic processes do not employ toner particles which have a sufficiently small size to provide the requisite high image resolution. While wet electrophotographic processes do employ toners with the requisite small particle size, they have other disadvantages such as the use of solvents that are environmentally undesirable.

In commonly assigned U.S. patent application Ser. Nos. 451,655 and 451,656, both filed Dec. 18, 1989, a thermal printer is disclosed which may be adapted for use as a direct digital color proofer with half-tone capabilities. This printer is arranged to form an image on a thermal print medium, or writing element, in which a donor element transfers a dye to a receiver element upon receipt of a sufficient amount of thermal energy. This printer includes a plurality of diode lasers which can be individually modulated to supply energy to selected areas of the medium in accordance with an information signal. The print-head of the printer includes one end of a fiber optic array having a plurality of optical fibers coupled to the diode lasers. The thermal print medium is supported on a rotatable drum, and the print-head with the fiber optic array is movable relative to the drum. The dye is transferred the receiver element as the radiation, transferred from the diode lasers to the donor element by the optical fibers, is converted to thermal energy in the donor element.

A direct digital color proofer utilizing a thermal printer such as that just described must be capable of consistently and accurately writing minipixels at a rate of 1800 dots per inch (dpi) and higher to generate half-tone proofs having a resolution of 150 lines per inch and above, as is necessary to adequately proof high quality graphic arts images such as those found in high quality magazines and advertisements. Moreover, it is necessary to hold each dot or minipixel to a density tolerance of better than 0.1 density unit from that prescribed in order to avoid visible differences between the original and the proof. This density control must be repeatable from image-to-image and from machine-to-machine. Moreover, this density control must also be maintained in each of the colors being employed in multiple passes through the proofer to generate a full color image.

Aspects of the apparatus which affect the density of the dots that make up the image include such things as variations and randomness of the intensity and frequency of the laser output, and variations in the output of the fiber optics which can vary from fiber to fiber and even within a single fiber as it is moved during the writing process. Variations in the finish of the drum surface as well as drum runout and drum bearing runout and variations in the parallelism of the translation of the print-head with respect to the axis of the drum also affect the density of the image dots. Any uneven movement of the imaging drum or of the writehead translation during the writing process, or anything which imparts jitter to any part of the imaging apparatus can adversely impact the quality of the finished image and its value as a representative proof. The difference in the distance between the ends of individual fibers and the drum surface also affects image density because of the fact that the end of the fiber bundle is flat while the surface of the drum is curved. Temperature variations in the print-head due to the ambient temperature of the machine as well as the fact that the writing process itself heats the print-head also influence the image density.

Variations in the print medium elements, such as variations in the thickness of the donor and receiver elements as well as the various layers that are a part thereof, can also affect the image density as it is being written.

Thus, it has been found necessary to provide a writing apparatus which meets all of the foregoing requirements and yet which is substantially automated to improve the control, quality and productivity of the proofing process while minimizing the attendance and labor necessary. Moreover, the writing apparatus must be capable of not only generating this high quality image consistantly, but it must be capable of creating a multi-color image which is in registration regardless of how the various individual images are supplied to the element comprising the final image. That means, in a thermal proofing process such as that described above, that various donor material sheets must be sequentially superposed with a single receiver sheet and then removed without disturbing the receiver sheet on the writing drum or platen, since maintaining the receiver sheet in one position during the entire writing process is what assures the necessary registration of the multiple superposed images that create the final proof.

Thus it will be seen that a method and apparatus for constantly, quickly and accurately assuring the removal of the finished receiver from the writing drum without damaging the proof carried thereby will enhance the productivity of the apparatus.

SUMMARY OF THE INVENTION

According to one embodiment of the present invention, a sheet removal apparatus is provided for unloading a sheet from a hollow drum member mounted for rotation about its axis and having a vacuum provided to the interior thereof. The apparatus includes means for supplying a vacuum to the interior of the drum and thence to first and second sets of vacuum openings through the surface of the drum member. The sheet is arranged to overlie and close the first set of vacuum openings with the second set of openings extending substantially parallel with an edge of the sheet and comprising only a small portion of the total number of vacuum openings through the drum. An exit blade is disposed adjacent the drum and has an edge proximate the drum that extends substantially parallel to the edge of the sheet. The exit blade is disposed with respect to the drum so as to form an acute angle with the surface thereof with the proximate edge of the blade closely adjacent the apex of the angle and parallel with the edge of the sheet so that, when the drum is rotated to a sheet removal position, the first set of vacuum openings lies beneath the acute angle when the edge of the sheet is disposed on the opposite side of the apex. The improvement comprises spacing the proximate edge of the exit blade sufficiently close to the surface of the drum that while the exit blade clears the sheet disposed on the drum member, the vacuum drawn through the second set of vacuum openings creates an area of relatively high pressure air at the apex whereby air is forced past the apex with sufficient force to lift the edge of the sheet from the surface of the drum.

According to another aspect of the present invention, a method is provided for removing a sheet from a hollow drum member which is mounted for rotation about its axis and which has a vacuum provided to the interior thereof. The apparatus includes means for supplying a vacuum to the interior of the drum and thence to first and second sets of vacuum openings through the surface thereof. The sheet is arranged to overlie and close the first set of vacuum openings. The second set of openings extends substantially parallel with an edge of the sheet and comprises only a small portion of the total number of vacuum openings through the drum. An exit blade is disposed adjacent the drum and has an edge proximate the drum which extends substantially parallel to the edge of the sheet. The exit blade is disposed with respect to the drum so as to form an acute angle with the surface thereof with the proximate edge of the blade closely adjacent the apex of the angle and parallel with the edge of the sheet. The proximate edge of the exit blade is located just far enough from the surface of the drum that the exit blade clears the sheet disposed on the drum member. The method comprises the steps of:

rotating the drum to a sheet removal position where the first set of vacuum openings lie beneath the acute angle and the edge of the sheet is disposed on the opposite side of the apex, and drawing air through the second set of vacuum openings by the vacuum in the drum and creating an area of sufficiently high pressure air at the apex to cause air to be forced past the edge of the exit blade with sufficient force to lift the edge of the sheet from the surface of the drum.

Various means for practicing the invention and other features and advantages thereof will be apparent from the following detailed description of illustrative, preferred embodiments of the invention, reference being made to the accompanying drawings.

DESCRIPTION OF THE PREFERRED EMBODIMENT

Overall Apparatus

Figure 1:
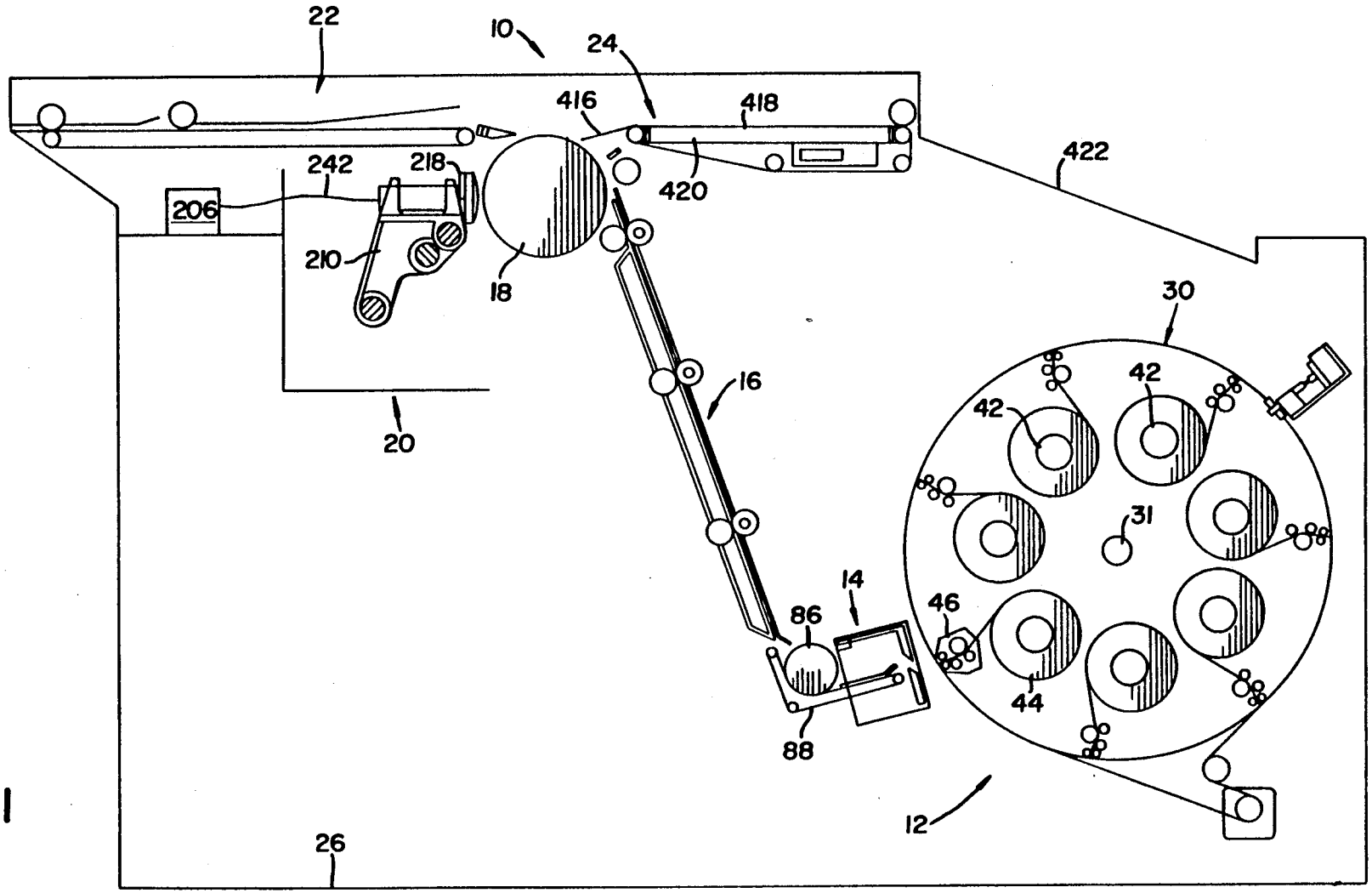
FIG. 1 is a side elevation schematic view of a proofing printer embodying the present invention.

The overall laser thermal printer proofer 10 of the present invention is illustrated in FIG. 1 and comprises generally a material supply assembly 12, a sheet cutter assembly 14, a sheet transport assembly 16, an imaging drum 18, a writehead assembly 20, a waste transport 22, and an image exit transport 24, which will all be described in greater detail hereinbelow. The arrangement of the components within the enclosure or cabinet 26 is such that the imaging drum 18 and the writehead assembly 20 are disposed in the upper central region of the cabinet. The material supply assembly 12 is disposed in the lower portion at one end of the cabinet, with the sheet cutter assembly 14 disposed adjacent the material supply assembly, again in the lower portion of the cabinet. The sheet transport assembly 16 extends from the sheet cutter assembly 14 to adjacent the imaging drum 18, generally opposite to the writehead assembly 20.

The overall operation of the apparatus comprises removing a portion of the supply of a receiver material from the material supply assembly 12, measuring it and cutting it to length in the sheet cutter assembly 14, and then transporting the cut sheet via sheet transport assembly 16 to the imaging drum 18 about which it is wrapped, registered, and secured. A length of donor material is then removed from the material supply assembly 12, cut to length by the sheet cutter assembly 14 and transported by the sheet transport assembly 16 to the imaging drum 18. At the imaging drum the donor material is wrapped around the drum and superposed in the desired registration with the receiver material already secured thereon. After the donor material is secured to the periphery of the drum, the writehead assembly is traversed axially along the drum as the drum is rotated, and an image is imparted to the receiver sheet. After the image has been written on the receiver sheet, the donor sheet is removed from the imaging drum, without disturbing the receiver sheet, and transported out of the apparatus via waste exit transport 22. Additional donor sheets are sequentially superposed with the receiver sheet on the drum and are imaged onto the receiver until the desired image is obtained and the completed image is exited from the apparatus via the image exit transport 24.

In the preferred embodiment, the roll supplies of donor and receiver materials provided to the printer apparatus are preferentially each wound on their respective cores in a unique fashion. The receiver material, on to which the image is to be transferred by the write head, and which is the surface of that web which is most sensitive to contact damage, is wound with the receiving surface on the outer surface of the web as it is wound upon the core. On the other hand, the donor material, with an active surface from which the dye material is transferred onto the receiver material, and which surface is most sensitive to contact damage, is wound with the dye material on the inner surface of the web. It will be seen that any curl in the respective materials, from being wound in the supply roll, will match and compliment the curvature of the imaging drum when the material is supported thereon, simplifying the feeding and adherence of the respective materials to the imaging drum. However, it has been found that the curl of the receiver sheet can interfere with the removal of the finished receiver sheet after the image has been imparted thereto.

Figure 2:
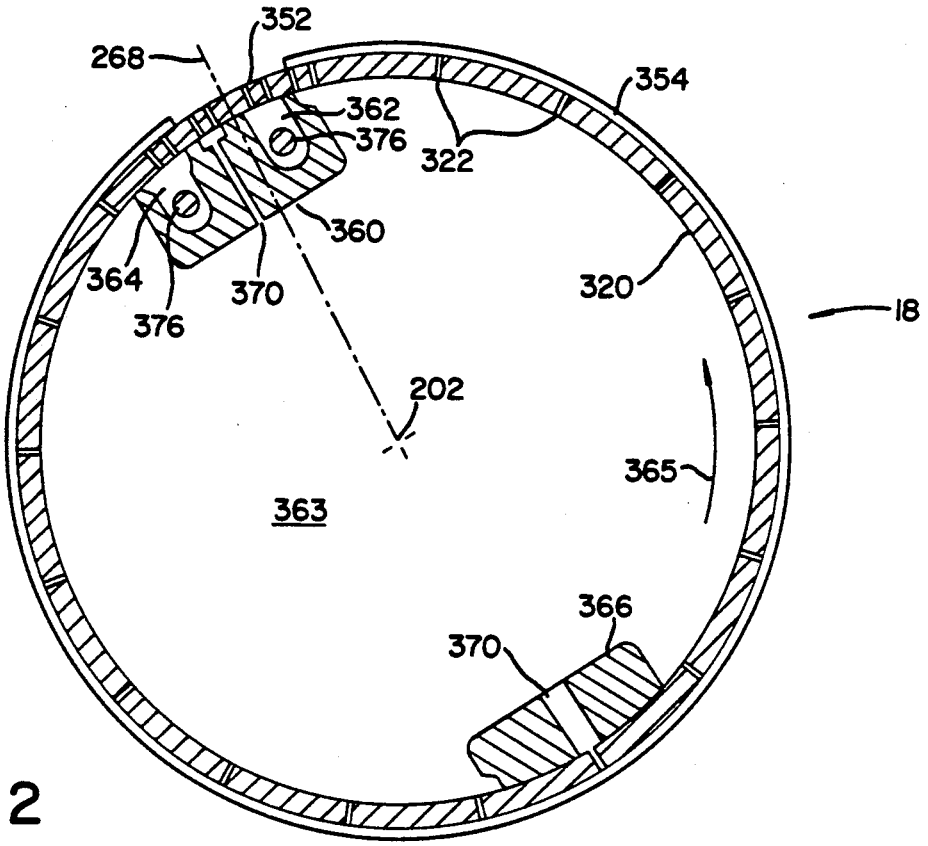
FIG. 2 is a cross sectional view of the imaging drum.

The imaging drum 18 are illustrated in FIG. 2 and generally comprises a hollow cylindrical shell 320 which is provided with a plurality of vacuum perforations 322 therethrough. The ends of the drum are closed by cylindrical plates (not shown) each of which is provided with a centrally disposed hub which extends through and is supported by appropriate bearings for rotation about its axis 202. One hub is connected to a drive motor and the other hub is provided with a central vacuum opening that is connected to a high-volume vacuum pump which, in the preferred embodiment, is capable of generating a vacuum of 50–60 inches of $H_2O$ at a volume of 60–70 cfm.

The outer surface of the imaging drum is provided with an axially extending "flat" 352 which extends approximately 8 degrees of the drum circumference. The receiver sheet 354 is illustrated superposed on the drum surface and extends nearly the full width of the drum and circumferentially from one edge of the flat 352 to the other, without overlapping it.

A valve block 360 is disposed axially along the inner surface of the drum substantially beneath the flat 352 on the outer surface thereof and provides two separately controllable vacuum chambers 362 and 364 beneath selected vacuum holes disposed on either side of the axial centerline 268 of the drum flat 352. The first chamber 362 extends along the plurality of vacuum openings disposed in the "leading edge" of the drum flat 352. The term "leading edge" refers to the portion of the drum flat onto which the leading edge of the donor material is disposed when it is superposed over the receiver sheet and the drum is spun in the normal writing direction as indicated by arrow 365. This chamber controls the hold-down of the leading end of the donor sheet, and will be referred to as the "donor vacuum chamber" hereafter. The second, separately controllable vacuum chamber 364 extends along the trailing edge of the receiver sheet when it is mounted on the drum, and will be referred to as the "receiver vacuum chamber" hereafter. The imaging drum is also provided with a counterbalance block 366 opposite to the vacuum chamber block 360 in order to provide dynamic balance to the drum. Each of the balancing block 366 and valve block 360 are provided with passageways 370 which permit vacuum to be applied to vacuum holes that would otherwise be covered by the respective blocks and which are not intended to be controlled by the vacuum chambers 362 and 364.

The purpose of the drum flat 352 is twofold; it assures that the leading and trailing ends of the donor sheets are somewhat protected from the effect of the air during the relatively high speed drum rotation during the writing process. Thus the air will have less tendency to lift the leading or trailing end of the donor sheets. The drum flat also assures that the leading and trailing end edges of the donor sheet are recessed from the drum periphery so that there is less chance that they can come into contact with other parts of the apparatus such as the end of the writing head and cause damage. The drum flat also acts to impart a bending force to the ends of the donor sheets when they are held to the drum surface by the vacuum within the drum so that, when that portion of the vacuum is turned off, that end of the donor sheet will tend to lift from the drum surface by the release of the bending force on the sheet. This is used to advantage in the removal of the donor sheet from the imaging drum.

The vacuum chambers 362 and 364 communcate with the central interior vacuum chamber 363 of the drum via passageways (not shown) in each of the end plates. A control valve is provided for each of the chambers and is arranged to mate with a cooperating seat which closes the respective passage, blocking the vacuum in the main drum chamber 363 from being transferred to the controlled vacuum chamber. At the same time that the valve member closes the passage, it also opens the valve chamber 364 to the atmosphere through an opening in the end wall of the drum. A full description of the operation of the vacuum chambers is contained in the above-identified application Ser. No. 749,399, entitled Multi-Chambered Imaging Drum.

The image sheet exit transport 24 comprises a stationary image exit blade 416 disposed adjacent the top surface of the imaging drum 18. The exit blade has an edge proximate the drum surface that extends substantially parallel to the edge of the receiver sheet. The exit blade is arranged to form an acute angle with the drum surface with the proximate edge of the blade closely adjacent the apex of the angle. An image sheet transfer belt 418 is arranged for cooperation with a vacuum table 420 to deliver a receiver sheet with an image formed thereon to an exit tray 422 in the exterior of the apparatus.

Figure 3:
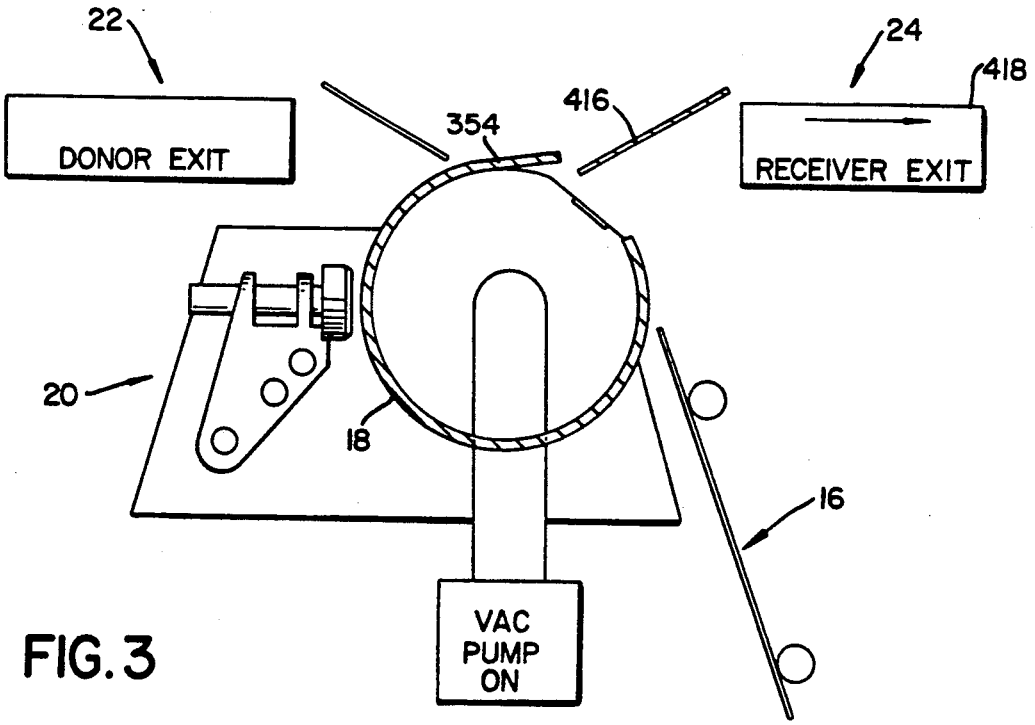
FIG. 3 is a partial schematic illustration of the apparatus of the present invention at a selected time during the unloading of the receiver material from the imaging drum.

Referring now to FIGS. 2 and 3, the present invention will be more thoroughly described. As described in the above-identified application Ser. No. 749,230, entitled Method and Apparatus for Loading and Unloading Superposed Sheets on a Vacuum Drum, when the finished receiver is to be unloaded, the imaging drum is stopped at the receiver unload position and both of the valves 376 are actuated, releasing the vacuum to both of the chambers 362 and 364. Since the donor sheet has already been removed from the drum, this releases the trailing end of the receiver sheet which should spring up away from the drum surface, substantially as illustrated, and the receiver exit transport belt 418 and vacuum 420 are activated. The condition of the overall system at this point is illustrated in FIG. 3. The imaging drum is then rotated clockwise until the lifted end edge of the receiver sheet is engaged by and lifted from the drum by the receiver sheet exit guide 416. The drum is further rotated clockwise driving the receiver sheet onto the receiver sheet exit guide onto the receiver exit transport belt 418. Although the foregoing receiver removal steps are normally accomplished, it has been found that under certain conditions, the core set of the receiver, or the ambient temperature and humidity conditions are such that the end of the receiver will not spring away from the drum surface a distance sufficient for the exit blade to engage the edge of the sheet when the vacuum is turned off from the chamber 364. Thus, it is not possible for the exit guide 416 to engage the end edge of the receiver to remove it from the drum. This, of course, adversely affects the productivity of the apparatus since it is necessary to stop the process and open the machine to manually remove the receiver.

A relatively simple, yet unexpected solution to the problem of the receiver sheet not lifting away from the drum surface has been found that requires only a simple adjustment to already existing components to ensure that the receiver sheet is lifted away from the drum surface for removal. What has been discovered is that, by positioning the edge of the exit blade 416 sufficiently close to the imaging drum surface and setting the angle that it forms with the drum surface within certain limits, the air flow caused by the suction of air through the only vacuum holes open in the drum surface to the vacuum pump create a positive flow of air under the edge of the exit blade that is sufficiently strong that it positively lifts the end edge of the receiver sheet from the surface of the drum. Referring to FIG. 2, it will be seen that when the vacuum is removed from the two chambers 362 and 364, and the trailing end edge of the receiver sheet 354, i.e. the edge over vacuum chamber 364, springs away from the drum surface, or even if that edge does not spring away, the only vacuum holes 322 that are open to the atmosphere is the set that is supplied by passageway 370 through the valve block 360. Thus, the vacuum pump, which is described above as having a relatively high volumetric capacity, is capable of pulling large quantities of air in through the few vacuum holes that are open to atmosphere. When the imaging drum is rotationally located as indicated schematically in FIG. 3, with the trailing edge of the drum flat adjacent the near edge of the exit blade 416, the set of vacuum holes drawing air from the atmosphere lie beneath the acute angle and the edge of the receiver sheet is disposed on the opposite side of the apex. Surprisingly, it has been found that when the exit blade forms an angle with the drum surface of between 25° and 45° and the proximate edge thereof is located at a distance of approximately 0.060 inches from the drum surface, the air flow into the vacuum holes is so great that a positive air pressure is created at the nip between the exit blade and the drum that causes air to be forced through the nip which is sufficiently strong that the edge of the receiver sheet is positively lifted from the drum surface. Accordingly, it has been found that by merely adjusting the width of the gap between the edge of the exit blade and the drum surface so that it just clears the superposed donor and receiver sheets, a flow of air is created by the operation of the other components of the apparatus which reliably and consistently lifts the edge of the receiver from the drum surface to permit its removal therefrom.

The invention has been described in detail with particular reference to a presently preferred embodiment, but it will be understood that variations and modifications can be effected within the spirit and scope of the invention.

We claim:

1. In a sheet removal apparatus for unloading a sheet from a hollow drum member mounted for rotation about its axis and having a vacuum provided to the interior thereof, said apparatus including means for supplying a vacuum to the interior of said drum and thence to first and second sets of vacuum openings through the surface of said drum member wherein said sheet overlies and closes said first set of vacuum openings and said second set of openings extends substantially parallel with an edge of said sheet and comprises only a small portion of the total number of vacuum openings through said drum, and an exit blade disposed adjacent said drum and having an edge proximate said drum and extending substantially parallel to said edge of said sheet, said exit blade being disposed with respect to said drum so as to form an angle with the surface thereof with said proximate edge of said blade closely adjacent the apex of the angle and parallel with said edge of said sheet whereby, when said drum is rotated to a sheet removal position, said second set of vacuum openings lie beneath the acute angle when said edge of said sheet is disposed on the opposite side of said apex, the improvement comprising:

spacing said proximate edge of said exit blade sufficiently close to the surface of said drum that while said exit blade clears said sheet disposed on said drum member the vacuum drawn through said second set of vacuum openings creates an area of relatively high pressure air at said apex whereby air is forced past said apex with sufficient force to lift said edge of said sheet from the surface of said drum.

2. The sheet removal apparatus according to claim 1 wherein said acute angle is between 25° and 45°.

3. The sheet removal apparatus according to claim 1 wherein the proximate edge of said exit blade is spaced from the surface of said drum approximately 0.060 inch.

4. The method of removing a sheet from a hollow drum member mounted for rotation about its axis and having a vacuum provided to the interior thereof, said apparatus including means for supplying a vacuum to the interior of said drum and thence to first and second sets of vacuum openings through the surface of said drum member wherein said sheet overlies and closes said first set of vacuum openings and said second set of openings extends substantially parallel with an edge of said sheet and comprises only a small portion of the total number of vacuum openings through said drum, and an exit blade disposed adjacent said drum and having an edge proximate said drum and extending substantially parallel to said edge of said sheet, said exit blade being disposed with respect to said drum so as to form an acute angle with the surface thereof with said proximate edge of said blade closely adjacent the apex of the angle and parallel with said edge of said sheet, said proximate edge of said exit blade being located just far enough from the surface of said drum that said exit blade clears said sheet disposed on said drum member, the method comprising the steps of rotating said drum to a sheet removal position where said second set of vacuum openings lie beneath the acute angle and said edge of said sheet is disposed on the opposite side of said apex, drawing air through said second set of vacuum openings by said vacuum in said drum and creating an area of sufficiently high pressure air at said apex to cause air to be forced past said edge of said exit blade with sufficient force to lift said edge of said sheet from the surface of said drum.

* * * * *